US009055658B2

(12) United States Patent
Stora et al.

(10) Patent No.: US 9,055,658 B2
(45) Date of Patent: Jun. 9, 2015

(54) NANOSTRUCTURED TARGET FOR ISOTOPE PRODUCTION

(75) Inventors: Thierry Stora, Thoiry (FR); Sandrina Fernandes da Visitacao, Belmonte (PT); Serge Mathot, Thoiry (FR); Paul Bowen, Lausanne (CH)

(73) Assignee: CERN—European Organization for Nuclear Research, Geneva (CH)

( * ) Notice: Subject to any disclaimer, the term of this patent is extended or adjusted under 35 U.S.C. 154(b) by 647 days.

(21) Appl. No.: 13/120,709

(22) PCT Filed: Jun. 18, 2009

(86) PCT No.: PCT/EP2009/004406

§ 371 (c)(1),
(2), (4) Date: May 3, 2011

(87) PCT Pub. No.: WO2010/034364

PCT Pub. Date: Apr. 1, 2010

(65) Prior Publication Data

US 2011/0235766 A1 Sep. 29, 2011

(30) Foreign Application Priority Data

Sep. 25, 2008 (EP) ..... 08016927

(51) Int. Cl.
*G21G 1/10* (2006.01)
*H05H 6/00* (2006.01)

(52) U.S. Cl.
CPC ... *H05H 6/00* (2013.01); *G21G 1/10* (2013.01)

(58) Field of Classification Search
CPC ..... G21B 1/00; G21B 1/11; G21B 1/19; G21G 1/00; G21G 1/04; G21G 1/10; G21G 7/00
USPC ..... 376/100, 151, 156
See application file for complete search history.

(56) References Cited

U.S. PATENT DOCUMENTS 4,341,731 A * 7/1982 Mills, Jr. ..... 376/156

FOREIGN PATENT DOCUMENTS

WO WO 2007/102860 A2 9/2007

OTHER PUBLICATIONS

Schmuki P et al: "On wafer Ti02 nanotube-layer formation by anodization of Ti-films on Si" Chemical Physics Letters Elsevier Netherlands, vol. 428, No. 4-6, Sep. 20, 2006, pp. 421-425, XP002540700 ISSN: 0009-2614.*

Alton G D et al: "A new method for infiltration coating complex geometry matrices with compound materials for ISOL production target applications" Nuclear Instruments &; Methods in Physics Research, Section A (Accelerators, Spectrometers, Detectors and Associated Equipment) Elsevier Netherlands, vol. 521, No. 1, Mar. 21, 2004, pp. 10.*

(Continued)

*Primary Examiner* — Jack W Keith
*Assistant Examiner* — Marshall O'Connor
(74) *Attorney, Agent, or Firm* — Sunstein Kann Murphy & Timbers LLP

(57) ABSTRACT

Disclosed is a target for isotope production, that comprises a porous, nanostructured material with structure elements having in at least one dimension an average size of 700 run or less, preferably 500 nm or less and most preferably 150 nm or less, said nanostructured material comprising one Of $Al_2O_3$, $Y_2O_3$ and $ZrO_2$.

10 Claims, 1 Drawing Sheet

(56) References Cited

OTHER PUBLICATIONS

Schmuki, et al., "On wafer $TiO_2$ nanotube-layer formation by anodization of Ti-films on Si," *Science Direct, Chemical Physics Letters*, vol. 428, No. 4-6, Sep. 20, 2006, pp. 421-425.

Alton, et al., "A new method for infiltration coating complex geometry matrices with compound materials for ISOL production target applications," *Science Direct, Nuclear Instruments and Methods in Physics Research*, vol. 521, Mar. 21, 2004, pp. 108-125.

Sawitowski, Thomas, "New Drug Delivery Systems—Examples of Applied Nanotechnology," *Proceedings Micro Tec 2000*, VDE World Microtechnologies Congress VDE Verlag, Berlin, Germany, vol. 1, 2000, pp. 343-346.

Portinha, et al., "Mechanical Properties of $ZrO_2$-$A1_2O_3$ Nanostructured PVD Coatings Evaluated by Nanoindentation," *Reviews on Advanced Materials Science*, Advanced Study Center, Russia, vol. 5, No. 4, 2003, pp. 311-318.

Stracener, et al., Targets used in the production of radioactive ion beams at the HRIBF, *Nuclear Instruments & Methods in Physics Research, (Accelerators, Spectrometers, Detectors and Associated Equipment)* Elsevier Netherlands, vol. 521, No. 1, Mar. 21, 2004, pp. 126-135.

Ulyanova, et al., "Investigation of the Structure of Nanocrystalline Refractory Oxides by X-ray Diffraction, Electron Microscopy, and Atomic Force Microscopy," *Crystallography Reports*, Russia, 2006, vol. 51, Suppl. 1, pp. 144-149.

Capostagno, Eros, Authorized Officer, International Searching Authority/EP, International Search Report and Written Opinion, dated Aug. 28, 2009, Application No. PCT/EP2009/004406, filed Jun. 18, 2009.

* cited by examiner

NANOSTRUCTURED TARGET FOR ISOTOPE PRODUCTION

FIELD OF THE INVENTION

The present invention relates to a target for isotope production as well as to a method for manufacturing such targets.

BACKGROUND OF THE INVENTION

Targets of the present invention can be used in the so-called isotope mass separation on-line (ISOL) technique. ISOL was invented in Copenhagen more than fifty years ago. In this method, a target of a thickness of typically one to a few tens of centimeters is bombarded with a beam of high energy particles, such as protons or heavy ions, with energies of several MeV or even GeV to produce radioactive isotopes via spallation, fission or fragmentation nuclear reactions. Typically, ISOL-target materials are made of refractory compounds, such as metals, carbides or oxides, which allow to work at high temperatures, which in turn allows to decrease diffusion and desorption times. The target material is typically placed in a target container in the form of pressed pills, metal foils, liquid metal or fibers.

Usually, materials used for targets have a microstructure or typical characteristic sizes, such as grain size, fiber diameter or foil thickness on the order of 5 to 50 μm. Upon interaction with the charged particle beam, the nuclear reaction products may diffuse through the material, into the surrounding container and effuse through a transfer line to an ion source, where they are ionized by selective ion sources, such as surface, laser or plasma ion sources. The target and the ion-source can in combination be regarded as a small chemical factory for converting nuclear reaction products into a radioactive ion beam. The ions are then electrostatically accelerated to some tens of keV, mass-separated in a dipole magnet and guided to the respective experiment or application as a radioactive ion beam.

Radioactive ion beams thus generated are of significant interest in a number of fields of research including nuclear physics, atomic physics, solid state physics, materials science, astrophysics, biophysics and medicine. Further applications of refractory materials exposed to high beam fluences concern spallation neutron sources or neutrino factories, new fission reactor lines (so called "Generation IV") and fusion reactor technology. In all of these applications, extensive irradiation damage during operation is experienced from a predetermined spectrum or different spectra of irradiating particles at a predetermined temperature. In spallation sources, usually a mixed spectrum of protons and neutrons interacts with the targets and structural materials, whereas in new fission reactor lines, a spectrum of mainly fast neutrons is produced. In fusion technology, structural materials received high neutron fluences of typically 14 MeV.

An ideal target for isotope production would have a high production cross section of the isotope of interest for the incoming beam characteristics, good diffusion and effusion properties, limited ageing and would be operable at a high temperature. The choice of the target material generally determines the achievable yields of the given isotopes. However, there are still a number of radioactive isotopes which are not accessible yet, either because it has not been possible to produce the element of interest, or because the yield is too low. Currently, only 1500 of the 3000 isotopes predicted have been experimentally produced and identified.

SUMMARY OF THE INVENTION

The problem underlying the invention is to provide a new target for isotope production, which have not yet been produced, or to generate isotopes at a higher yield than what is currently possible.

This problem is solved by a target for isotope production as well as a method of producing a target. Preferable embodiments are defined in the dependent claims.

According to the invention, the target comprises a porous, nanostructured material with structure elements having in at least one dimension an average size of 700 nm or less, preferably 500 nm or less and most preferably 150 nm or less, where the nanostructured material comprises one of $Al_2O_3$, $Y_2O_3$ or $ZrO_2$.

The nanostructured material could for example be a porous ceramic in which the structure elements are particles or grains within said ceramic. Herein, the structure may be controlled and formed by a suitable powder of particles or grains. Alternatively, the porous nanostructured material may have a cell structure, in which the structure elements are formed by the individual cells. In case of an elongated cell structure, as is for example obtained by anodization growth as described in more detail below, at least one dimension of the cell, i.e. the width, would be smaller than the above mentioned size. Further examples of nanostructured materials may have the form of nanowires, nanotubes, nanodots and/or nanoplates.

For example a nanoplate with an organized cell structure can be obtained by using the conventional two-step anodization or the high-field anodization processes after which at least one dimension of the cell, i.e. the width, would be smaller than the above mentioned size. These processes are per se known from the formation of so called "porous anodic alumina" (PAA) films. In this anodizing method, a porous oxide film is grown on an anode metal plate immersed in an acid electrolyte. The method is conducted such that adjacent pores in the porous oxide film are spaced by less than 700 nm, preferably by less than 500 nm and most preferably by less than 100 nm apart.

As illustrated by these examples, in the present disclosure, the term "nanostructured material" relates to a material having a microstructure on a nanometric scale, i.e. well below 1 μm and preferably below 150 nm.

Put differently, nanostructured materials may be defined as materials whose structural elements, for example clusters, crystallites or molecules have dimensions on a nanometric scale. By varying the size of the structural elements and controlling their interactions, the fundamental properties of nanostructured materials synthesized from these building units may be tuned. The advantage of using a porous nanostructured material as a target material is that it allows for shorter isotope release time due to a faster diffusion of the isotope to the surface of the structure elements, such that isotopes with shorter lifetimes can still be released at a considerable yield. However, according to common wisdom, it is currently believed to be impossible to make use of a target material having a structure on a sub-micrometric scale, due to the sintering of particles expected to occur at the target temperatures during operation, resulting in grain growth and removal of pores. The sintering rate is known to depend in part on the initial particle dimension and is typically inversely proportional to the third power of the dimension of the particle. As is for example explained in L. C. Carraz et al., "Fast Release of Nuclear Reaction Products from Refractory Matrices", Nuclear Instruments and Methods 148 (1978), 217-230, particle sizes below 1-5 μm are believed to be not suitable when a stable grain structure is desired.

However, contrary to this technical prejudice, the inventors found out that stable target materials can in fact be made even on a nanometric scale, when $Al_2O_3$, $Y_2O_3$ or $ZrO_2$ are used as the main constituent of the target material. With these nanostructured materials, faster diffusion and thus shorter release times are observed, which according to current investigations are believed to allow for the production of short-lived isotopes at considerable yield.

In a preferred embodiment, the nanostructured material comprises a lanthanide or alkaline earth metal dopant. As has been observed by the inventors, this type of dopant helps to inhibit grain growth and preserve the nanostructure under operation of the target. For example, doping alumina with a small quantity of magnesia enhances the densification rate, but reduces the grain growth. Such doping is also found to decrease the transition temperature from the γ-phase to the α-phase of the $Al_2O_3$.

The decrease of the transition temperature from the γ- to the α-phase of the $Al_2O_3$ to about 1050° C. is described in L. Radonjic et al., "Microstructural and sintering of magnesia doped, seeded, different boehmite derived alumina", Ceramics International 25 (1999) 567-575. In some cases the addition of dopants like barium or praseodymium can increase this temperature up to 1315° C. as referred to by S. Rossignol et al., "Effect of doping elements on the thermal stability of transition alumina", International Journal of Inorganic Materials 3 (2001) 51-58.

$ZrO_2$ is another material in which the influence of the dopant may introduce changes in the phase transition temperature, becoming tetragonal at 1170° C. and finally cubic at 2300° C. Normally it is stabilized with magnesia, yttria or calcium dopants which form a solid solution with zirconia and give rise to a structure that is a mixture of cubic and monoclinic zirconia. This material (termed "partially-stabilized zirconia" (PSZ)) exhibits the optimum balance of thermal expansion and thermal shock resistance properties.

Suitable dopants were found to comprise barium, magnesium, yttrium, zirconium, lanthanum, cerium, neodymium and/or ytterbium. Suitable dopant concentrations are found to be between 100 and 1000 ppm, preferably between 300 and 700 ppm.

Preferably, the nanostructured material has a specific surface between 0.5 and 20 $m^2/g$ at the operation temperature of the target.

In a preferred embodiment, the nanostructured material is attached to a metal foil. Herein, the metal is preferably a refractory metal having a high melting point. Due to the high heat conductivity of the metal foil, this allows to dissipate heat under operation of the target i.e. during ion bombardment thereof, such that a grain growth and sintering can be inhibited even at fairly high intensities of the incoming accelerated particle beam. In fact, the combination of a heat conductive foil with a porous nanostructured material has proven to be a very simple but yet extremely efficient means to obtain targets which at the same time allow for high primary beam intensity, and thus a higher overall yield, shortened isotope release time to produce more intense exotic isotope beams and stability of the nanostructure of the target material.

The nanostructured material and the metal foil may be joined by a mechanical connection, such as by a screw, fit or clamp connection. Alternatively, the nanostructured material and the metal foil can be joined by brazing or solid state diffusion, as will be explained in more detail below.

It is preferable to match as much as possible the coefficients of thermal expansion (TCE) of the different materials. The mechanical stresses can be reduced by a controlled heating and cooling rate during brazing of diffusion bonding and by the introduction of selected flexible or ductile interlayers.

Preferably, the target comprises a plurality of pairs of pellets of said nanostructured material, where each two pellets forming a pair of pellets are joined opposite to each other at opposite sides of a single metal foil.

In a preferred embodiment, the metal foil is made of niobium foil having a thickness of 0.35 to 1 mm, and the nanostructured material is brazed onto this foil using a thin foil or cladding layer of Ti and/or TA6V as a filler material. A combination of an $Al_2O_3$ nanostructured material and a niobium foil has been found to be particularly advantageous, since their thermal expansion coefficients match very well. $ZrO_2$ and $Y_2O_3$ are also believed to be appropriate since it exhibits a similar coefficient of thermal expansion up to 2000 K.

According to an aspect of the invention, a method of manufacturing a target for isotope production comprises a step of providing a powder of one of $Al_2O_3$, $Y_2O_3$ and $ZrO_2$ having an average grain size of less than 700 nm, preferably less than 500 nm, more preferably less than 150 nm and most preferably less than 100 nm and a step of synthesizing a solid material from said powder while preserving a grain structure with an average grain size in the solid material of less than 700 nm, preferably less than 500 nm, more preferably less than 150 nm and most preferably less than 100 nm.

The synthesizing step may involve slip casting, top casting or cold unidirectional pressing, where the cold unidirectional pressing may be followed by a heat treatment at 1100° C. to 1450° C., preferably at 1200° C. to 1300° C. With these synthesizing steps, a porous ceramic-type material can be obtained, in which the nanometric grain structure is preserved, thus allowing for a decreased release time of isotopes.

The fabrication process can also be made using deposition techniques, where the various materials are introduced above a substrate, and react and form the ceramic on the substrate.

As mentioned above, in an alternative embodiment, a method of manufacturing a target for isotope production is based on a procedure also known as anodization, which is per se known from the formation of so called "porous anodic alumina" (PAA) films. In this anodizing method, a porous oxide film is grown on an anode metal plate immersed in an acid electrolyte. The method is conducted such that adjacent pores in the porous oxide film are spaced less than 700 nm, preferably less than 500 nm and most preferably less than 150 nm apart. The preferred oxide film to be formed is $Al_2O_3$, but a similar method can also be applied for $Y_2O_3$, $ZrO_2$ or $HfO_2$. Preferably, the acid electrolyte comprises one of sulphoric acid, oxalic acid and phosphoric acid.

Preferably, the oxide film growth by anodization is followed by a step of annealing, where the annealing temperature is preferably below 1270° C., most preferably below 1220° C. Due to the annealing, the oxide can be transformed from the amorphous phase to the crystalline phase to obtain a stabilized material while preserving the nanostructure thereof.

DESCRIPTION OF THE PREFERRED EMBODIMENTS

For the purposes of promoting an understanding of the principles of the invention, reference will now be made to the preferred embodiments, and specific language will be used to describe the same. It will nevertheless be understood that no limitation of the scope of the invention is thereby intended, such alterations and further modifications in the illustrated product and method and such further applications of the principles of the invention as illustrated therein being contemplated as would normally occur now or in the future to one skilled in the art to which the invention relates.

1. Synthesis by Cold Unidirectional Pressing

Figure 1:
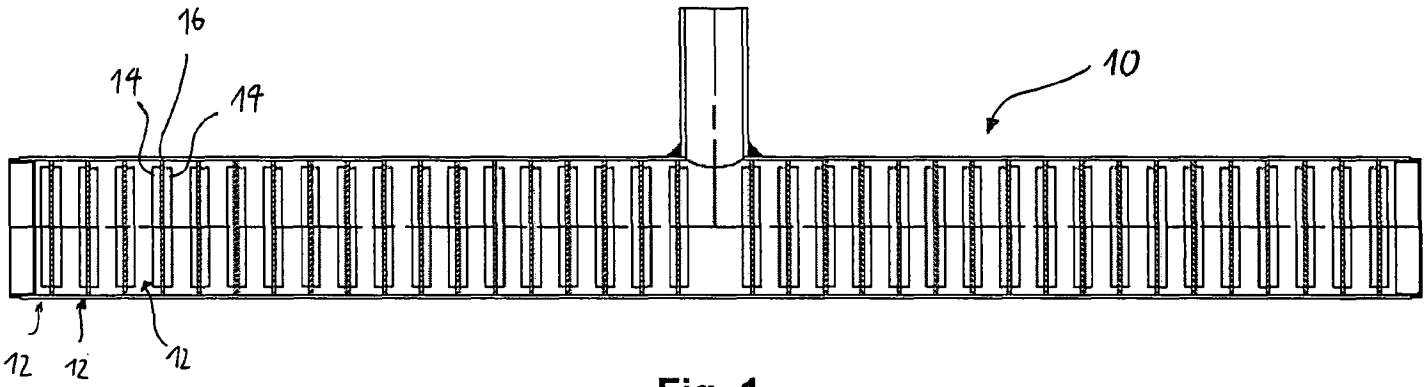
FIG. 1 is a schematic sectional view of a target assembly comprising 36 pellets of braze metal-ceramic composite.

In one embodiment, porous $Al_2O_3$ target materials can be obtained by weighing 1 g of nano-grained transition-alumina powder ($\gamma$-$Al_2O_3$) of the type "CR-B105", available of Baikowsky, France and feeding it in a stainless steel cylindrical die with a diameter of 20 mm. The powder is pressed by a cold unidirectional press with a pressure of 8 MPa, followed by a heat treatment at 1400° C. under a vacuum for one day. The final mean bulk density of this material was obtained at 1.83 g/cm$^3$ and the specific surface was 2.2 m$^2$/g.

In an alternative embodiment, the target material can be produced in a hot isostatic pressing of the same powder. The hot isostatic pressing is preferably performed at a temperature between 1200° C. and 1300° C. The reason for choosing this temperature is as follows: First, the structural transformation of $\gamma$-$Al_2O_3$ into well crystallized $\alpha$-$Al_2O_3$ occurs at about 1200° C. Also, up to a temperature of 1200° C., the densification of the material increases rapidly, while the grain growth is still slow. Beyond 1200° C., a densification by coarsening takes place, and at high temperatures over 1300° C., the densification proceeds only by coarsening. Accordingly, by hot isostatic pressing between 1200° C. and 1300° C., both densification and sintering can be carried out, while still preserving the structure of the grains on a nanometric scale.

In both cases, the densification behavior and microstructure development can be controlled by adding dopants, which allows a densification at lower temperatures, lowers the transformation temperature to $\alpha$-alumina and reduces the grain growth. As a dopant, barium oxide and nitride solutions of magnesium, yttrium, zirconium, lanthanum, cerium, neodymium and ytterbium are suitable. Suitable doping levels are between 100 and 1000 ppm.

2. Synthesis by Slip Casting

In an alternative embodiment, the nanostructured material is produced by slip casting. In slip casting, a slurry is poured or pumped into a permeable mold having a particular clear shape. Capillary suction and filtration concentrate the solids into a cast adjacent to the wall of the mold. After an extended drying process at room temperature, the samples are submitted to a programmed firing process.

In a preferred embodiment, a slip casting suspension is prepared by dispersing alumina ($Al_2O_3$) powder in a dispersion and adding microspheres. In the specific embodiment, the dispersion of alumina powder was made with a polyacrylic acid (PAA) of molecular mass 200 g/mole with a concentration of 6 weight-% in an aqueous solution, as available from Acros Organics. The microspheres are added to produce large regularly-spaced pores which lead to an open structure in the resultant product.

In specific embodiments, two different microspheres have been employed: The first type was a carboxylated polystyrene latex (PS) microsphere with a diameter of 0.95 μm to 1.10 μm and a density of 1,059 g/cm$^3$ (Estapor-K1 100 functionalized microspheres), the second type were polymethyl methacrylate (PMMA) functionalized polymer spheres having diameters from 50 μm to 100 μm and a density of 1.22 g/cm$^3$. The resultant pores are random, but the topology is a long, rod-shaped tunnel, which contributes to high permeability.

The PMMA microspheres are forming a strong polymer network and dominate the colloidal property and thereby the strength of the consolidated green bodies. On the other hand, the PS functionalized microspheres, being insoluble in water at room temperature, increase the viscosity of the slurry and the stability of the foamed slurry. The PS-microspheres also act as pore formers to introduce connectivity between pores and hence to increase the open porosity. By controlling the ratios of the PMMA and PS-functionalized microspheres in the slurry, it is possible to control the properties of the cast body to obtain a desired micro-structure. For more details, reference is made to Paul Bowen et al., Colloidal Processing and Sintering of Nano-Sized Transition Aluminas, Powder Technology, 157, (2005), 100-107.

The slip casting was performed in cylindrical rubber molds with a diameter of 20 mm and a depth of approximately 20 mm.

While in the specific embodiment, $Al_2O_3$ has been used, alternatively, $ZrO_2$ or $Y_2O_3$ can be used. In particular, zirconium and yttrium oxide targets are of special interest, since they provide pure beams of a wide range of isotopes, such as He, Ne, S, Ar, Cr, Co, Ni, Cu, Zu, Ga, Ge, As, Br, Kr and Te.

3. Target Formation by Anodizing

In an alternative embodiment, the micro-structured target material is formed by an electrochemical process called "anodizing". In this method, $Al_2O_3$ is grown on a metal plate, preferably aluminum, immersed in an acid electrolyte.

As is known in the art, in this anodizing process, an oxide with a cellular structure with a central pore in each cell is grown. The cell and the pore dimensions depend on the bath composition, the temperature and the voltage, but the result is always an extremely high density of fine pores. The cell diameter is usually in the range of 30 to 300 nm, and the pore diameter is typically a third to a half of cell diameter. Accordingly, by anodizing a nanostructured material can be obtained as well.

After formation of an anodic aluminum oxide membrane with nano-pores, in a preferred embodiment an annealing treatment is performed in which the amorphous phase is transferred to a crystalline phase while preserving the nano-pore structure. Again, such a nano-pore structure is an example of a nanostructured material which provides short diffusion times of isotopes and thus decreased release times.

4. Formation of Compound Targets

In a preferred embodiment, a nanostructured material obtained by one of the above described methods is attached to a metal foil. Due to its heat conductivity, the metal foil allows to dissipate heat from the nanostructured material, which in turn allows to prevent sintering and coarsening of the nanostructures due to excessive heat when the target is in operation. Accordingly, the nanostructure of the target can be preserved in operation.

In a preferred embodiment, the nanostructured material is a nanostructured $Al_2O_3$, and the metal foil is made of a Nb-foil. A combination of $Al_2O_3$ and niobium is preferable, since their thermal expansion coefficients match closely, such that the bonded interface is virtually free of thermal stresses. Also, niobium and alumina are chemically compatible, resulting in interfaces with no chemical reaction layer when bonded in vacuum.

In the specific embodiment, nanostructured $Al_2O_3$ material was in the shape of a pellet obtained in a method as described in section 1. above, and the metal foil was a 0.5 mm thick niobium foil. The $Al_2O_3$-pellet was brazed to the Nb-foil using a 0.1 mm titanium alloy (TA6V) as a braze filler active material.

Instead of brazing, the $Al_2O_3$-pellets could also be attached to the metal foil by solid state diffusion, or by a mechanical connection using screws, a clamp or a fitting connection.

In FIG. 1, a cross-sectional view of a full target assembly 10 comprising 36 pellets 12 of brazed metal-ceramic composite is shown. Each pellet 12 comprises two $Al_2O_3$ nanostructured ceramic discs 14 joint on opposite sides of an Nb metal foil 16. In the embodiment shown, the $Al_2O_3$ discs have a thickness of 1 mm each and the Nb-foil has a thickness of 0.5 mm. Although not shown in FIG. 1, the $Al_2O_3$-pellets 14 are brazed to the Nb-foil using a 0.1 mm thick titanium alloy layer as a brazing material. In the preferred embodiment, the titanium alloy is a TA6V alloy comprising 90% Ti, 6% Al and 4% V.

Figure 2:
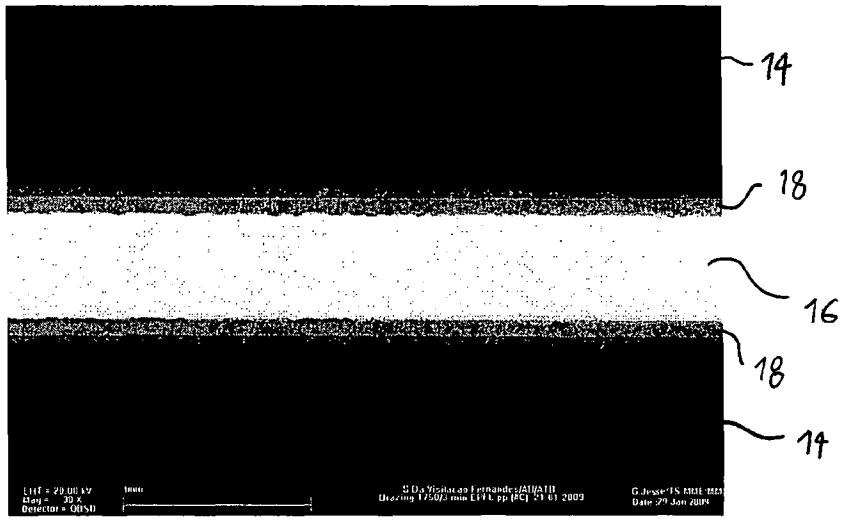
FIG. 2 is a SEM sectional image showing the brazing interface between an Nb-foil and $Al_2O_3$ ceramic discs forming a pellet.

In FIG. 2, as scanning electron microscopy (SEM) image of the pellet brazing interface is shown, which has been obtained with an electron back scatter diffraction (EBSD) detector. In FIG. 2, the TA6V brazing interface layer 18 located between the Nb-foil and the nanostructured $Al_2O_3$ ceramic can clearly be seen.

Although preferred exemplary embodiments are shown and specified in detail in the specification, these should be viewed as purely exemplary and not as limiting the invention. It is noted in this regard that only the preferred exemplary embodiments are shown and specified, and all variations and modifications should be protected that presently or in the future lie within the scope of protection of the invention.

The invention claimed is:

1. A method of manufacturing a target for isotope production, the method comprising:

growing a nanograined solid material as a porous oxide film on an anode metal plate immersed in an acid electrolyte bath;

adjusting the temperature and the voltage of the acid electrolyte bath such that adjacent pores in the porous oxide film are spaced less than 700 nm; and retaining the nanograined solid material on a substrate having a melting point adapted to withstand bombardment by ions of energy exceeding 14 MeV.

2. The method of claim 1, wherein said oxide film is an $Al_2O_3$ film.

3. The method of claim 1, wherein said acid electrolyte comprises one of sulfuric acid, oxalic acid and phosphoric acid.

4. The method of claim 1, wherein said oxide film growth is followed by a step of annealing.

5. The method of claim 4, wherein said annealing is performed at a temperature below 1270° C.

6. The method of claim 1, further comprising a step of joining the nanograined solid material with a metal foil.

7. The method of claim 6, wherein said nanograined solid material and said metal foil are joined by brazing.

8. The method of claim 7, wherein, in said brazing, a foil or cladding layer of filler material is interposed between said nanograined solid material and said foil.

9. The method of claim 8, wherein said metal foil is a Nb-foil.

10. The method of claim 9, wherein said Nb-foil has a thickness of 0.1 to 1 mm.

* * * * *